US009311868B2

(12) United States Patent
Lim et al.

(10) Patent No.: US 9,311,868 B2
(45) Date of Patent: Apr. 12, 2016

(54) LIQUID CRYSTAL DISPLAY DEVICE HAVING A KICKBACK DETECTOR

(71) Applicants: Sang Min Lim, Cheonan-si (KR); Jeong Geun Yoo, Yongin-si (KR); Kwang Sae Lee, Cheonan-si (KR)

(72) Inventors: Sang Min Lim, Cheonan-si (KR); Jeong Geun Yoo, Yongin-si (KR); Kwang Sae Lee, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 142 days.

(21) Appl. No.: 13/912,043

(22) Filed: Jun. 6, 2013

(65) Prior Publication Data

US 2014/0022153 A1 Jan. 23, 2014

(30) Foreign Application Priority Data

Jul. 17, 2012 (KR) ..... 10-2012-0077859

(51) Int. Cl.
*G09G 3/36* (2006.01)

(52) U.S. Cl.
CPC ..... *G09G 3/3611* (2013.01); *G09G 3/3648* (2013.01); *G09G 2320/0247* (2013.01); *G09G 2330/08* (2013.01)

(58) Field of Classification Search
CPC .. G09G 3/3611; G09G 3/3648; H09K 5/0039
USPC ..... 345/90, 92
See application file for complete search history.

(56) References Cited

U.S. PATENT DOCUMENTS

| | | | | |
|---|---|---|---|---|
| 2002/0043933 | A1* | 4/2002 | Ooishi et al. | 313/512 |
| 2011/0102719 | A1* | 5/2011 | Kakehi et al. | 349/122 |
| 2011/0221983 | A1* | 9/2011 | Lee | 349/33 |
| 2012/0126901 | A1* | 5/2012 | Leung et al. | 331/17 |

FOREIGN PATENT DOCUMENTS

KR 10-2011-0102673 A 9/2011

* cited by examiner

*Primary Examiner* — Jonathan Blancha
(74) *Attorney, Agent, or Firm* — Lewis Roca Rothgerber Christie LLP

(57) ABSTRACT

A liquid crystal display device that can reduce picture quality deterioration due to a kickback voltage and can accurately detect a kickback voltage is provided. The liquid crystal display device includes: a liquid crystal panel including a detector configured to generate a kickback voltage detection signal, a detection line for supplying the kickback voltage detection signal, and a ground pattern along and adjacent to one side of the detection line; and a common voltage generator connected to the detection line and configured to generate a common voltage corresponding to the kickback voltage detection signal and to supply the generated common voltage to the liquid crystal panel.

7 Claims, 7 Drawing Sheets

LIQUID CRYSTAL DISPLAY DEVICE HAVING A KICKBACK DETECTOR

CROSS-REFERENCE TO RELATED APPLICATION

This application claims priority to and the benefit of Korean Patent Application No. 10-2012-0077859, filed on Jul. 17, 2012 in the Korean Intellectual Property Office, the entire content of which is incorporated herein by reference.

BACKGROUND

1. Field

Aspects of embodiments of the present invention relate to a liquid crystal display device.

2. Description of the Related Art

With the trend toward lighter and slimmer displays, including portable display devices such as notebook computers, mobile phones, or portable media players (PMPs) as well as home display devices such as TV sets or monitors, a variety of flat panel displays are widely used. There are a wide variety of flat panel displays, including liquid crystal display devices, organic electroluminescent display devices, electrophoretic display devices, and so on.

Among the flat panel displays, liquid crystal display devices include a liquid crystal layer containing liquid crystal molecules. The arrangement of the liquid crystal molecules varies according to the voltage applied to the liquid crystal layer, and the light transmittance of the liquid crystal layer varies accordingly. An example liquid crystal display device includes a plurality of pixel areas that display a desired image by controlling the voltage applied to the liquid crystal layer included in each of the pixel areas. Each such liquid crystal layer may serve as a capacitor, which will hereinafter be referred to as a liquid crystal capacitor. Thus, the liquid crystal display device displays a desired image by controlling the voltage applied to both ends of the liquid crystal capacitor.

The liquid crystal display device is a switching device for applying a voltage to the liquid crystal capacitor and may employ a thin film transistor. Kickback voltage may be generated due to parasitic capacitance formed between a gate and a drain of the thin film transistor. If kickback voltage is generated, the voltage applied to the liquid crystal capacitor varies, resulting in flicker or image sticking in the image displayed on the liquid crystal display device. For example, in a liquid crystal display device in which the polarity of a data voltage is inverted at 60 Hz, there is a difference in brightness between an odd-numbered frame and an even-numbered frame due to kickback voltage, resulting in flicker of 30 Hz. In addition, if the liquid crystal display device is continuously driven when kickback voltage is generated, a DC offset is applied to the liquid crystal layer, which may change light transmittance of the liquid crystal layer, thereby resulting in a residual image.

SUMMARY

Embodiments of the present invention provide for a liquid crystal display device that can reduce picture quality deterioration due to kickback voltage. Further embodiments of the present invention provide for a liquid crystal display device that can accurately detect kickback voltage. Aspects of the present invention will be described in or be apparent from the following description of exemplary embodiments.

According to an exemplary embodiment of the present invention, a liquid crystal display device is provided. The liquid crystal display device includes: a liquid crystal panel including a detector configured to generate a kickback voltage detection signal, a detection line for supplying the kickback voltage detection signal, and a ground pattern along and adjacent to one side of the detection line; and a common voltage generator connected to the detection line and configured to generate a common voltage corresponding to the kickback voltage detection signal and to supply the generated common voltage to the liquid crystal panel.

The liquid crystal panel may include a first substrate, a second substrate facing the first substrate, a liquid crystal layer between the first substrate and the second substrate, and a sealing pattern adhering the first substrate to the second substrate and sealing the liquid crystal layer. The ground pattern may contact the sealing pattern.

The ground pattern may be parallel with the sealing pattern at a contact region of the ground pattern and the sealing pattern.

The sealing pattern may be arranged along a boundary where the first substrate and the second substrate overlap each other.

The detector may be configured to receive a reference voltage and to output the reference voltage as changed by a kickback voltage as the kickback voltage detection signal.

The detector may include a detection pixel.

The detection pixel may include: a thin film transistor including a gate connected to a gate line, a source for receiving the reference voltage, and a drain for outputting the kickback voltage detection signal; and a liquid crystal capacitor including an end connected to the drain and another end for receiving a common voltage.

The detection pixel may further include a storage capacitor including an end connected to the drain and another end for receiving the common voltage.

The liquid crystal panel may include a display region and a peripheral region including the detection pixel.

According to another exemplary embodiment of the present invention, a liquid crystal display device is provided. The liquid crystal display device includes: a liquid crystal panel including a detector configured to generate a kickback voltage detection signal, a detection line for supplying the kickback voltage detection signal, a first ground pattern along and adjacent to one side of the detection line, and a second ground pattern along and adjacent to another side of the detection line; and a common voltage generator connected to the detection line and configured to generate a common voltage corresponding to the kickback voltage detection signal and to supply the generated common voltage to the liquid crystal panel.

The liquid crystal panel may include a first substrate, a second substrate facing the first substrate, a liquid crystal layer between the first substrate and the second substrate, and a sealing pattern adhering the first substrate to the second substrate and sealing the liquid crystal layer. The ground pattern or the second ground pattern may contact the sealing pattern.

The first ground pattern or the second ground pattern may be parallel with the sealing pattern at a contact region of the first ground pattern or the second ground pattern, and the sealing pattern.

The liquid crystal panel may further include a common voltage line for supplying the common voltage. The first ground pattern may be between the common voltage line and the detection line.

The detector may be configured to receive a reference voltage and to output the reference voltage as changed by a kickback voltage as the kickback voltage detection signal.

The liquid crystal panel may further include a reference voltage line for supplying the reference voltage. The second ground pattern may be between the reference voltage line and the detection line.

The liquid crystal panel may further include a third ground pattern adjacent to and along the reference voltage line. The reference voltage line may be between the second ground pattern and the third ground pattern.

The liquid crystal panel may include a first substrate, a second substrate facing the first substrate, a liquid crystal layer between the first substrate and the second substrate, and a sealing pattern adhering the first substrate to the second substrate and sealing the liquid crystal layer. The third ground pattern may contact the sealing pattern.

The detector may be configured to receive a reference voltage and to output the reference voltage as changed by a kickback voltage as the kickback voltage detection signal.

The detector may include a detection pixel. The detection pixel may include: a thin film transistor including a gate connected to a gate line, a source for receiving the reference voltage, and a drain connected to the detection line; and a liquid crystal capacitor including an end connected to the drain and another end for receiving a common voltage.

The detection pixel may further include a storage capacitor including an end connected to the drain and another end for receiving the common voltage.

Embodiments of the present invention provide for a liquid crystal display device that can reduce picture quality deterioration due to kickback voltage. In addition, embodiments of the present invention provide for a liquid crystal display device that can accurately detect kickback voltage.

BRIEF DESCRIPTION OF THE DRAWINGS

The above and other features and aspects of the present invention will become more apparent by describing in detail embodiments thereof with reference to the attached drawings in which.

DETAILED DESCRIPTION

The present invention will now be described more fully hereinafter with reference to the accompanying drawings, in which embodiments of the invention are shown. This invention may, however, be embodied in different forms and should not be construed as limited to the embodiments set forth herein. Rather, these embodiments are provided to more fully convey the scope of the invention to those skilled in the art. The same reference numbers indicate the same components throughout the specification. In the attached figures, the thickness of layers and regions may be exaggerated for clarity.

It will also be understood that when a layer is referred to as being "on" another layer or substrate, it can be directly on the other layer or substrate, or intervening layers may also be present. In contrast, when an element is referred to as being "directly on" another element, there are no intervening elements present. Unless defined otherwise, all technical and scientific terms used herein have the same meaning as commonly understood by one of ordinary skill in the art to which this invention pertains. It is noted that the use of any examples, or exemplary terms provided herein is intended merely to better illuminate exemplary embodiments of the present invention and is not a limitation on the scope of the invention unless otherwise specified. Further, unless defined otherwise, terms defined in generally used dictionaries may not be overly interpreted.

Figure 1:
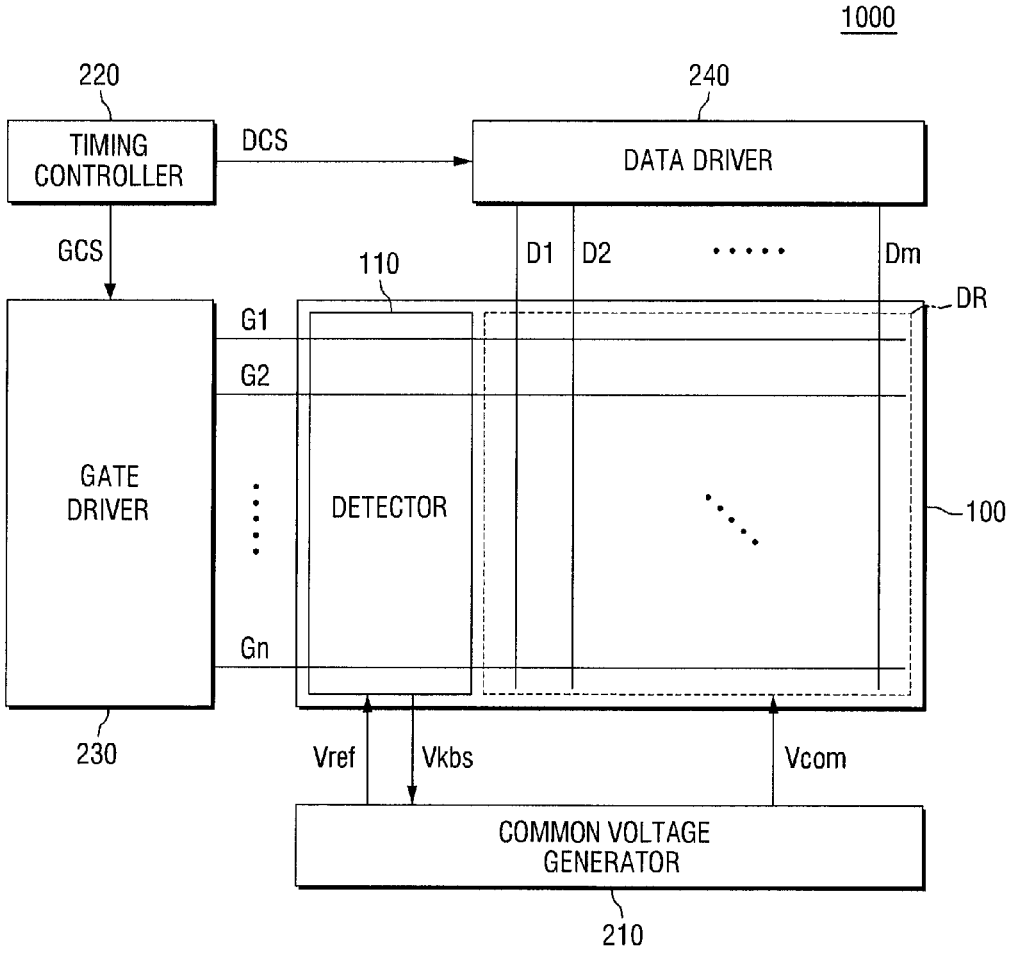
FIG. 1 is a block diagram of a liquid crystal display device according to an embodiment of the present invention.

FIG. 1 is a block diagram of a liquid crystal display device 1000 according to an embodiment of the present invention. Referring to FIG. 1, the liquid crystal display device 1000 includes a liquid crystal panel 100 and a common voltage generator 210. The liquid crystal panel 100 has a display region DR in which an image is displayed, and a peripheral region other than the display region DR. The liquid crystal panel 100 includes gate lines G1, G2, . . . , and Gn and data lines D1, D2, . . . , and Dm. The liquid crystal panel 100 includes a plurality of pixels arranged in a matrix defined in the display region DR by crossing regions of the gate lines G1, G2, . . . , and Gn and data lines D1, D2, . . . , and Dm. An exemplary pixel will now be described in more detail with reference to FIG. 2.

Figure 2:
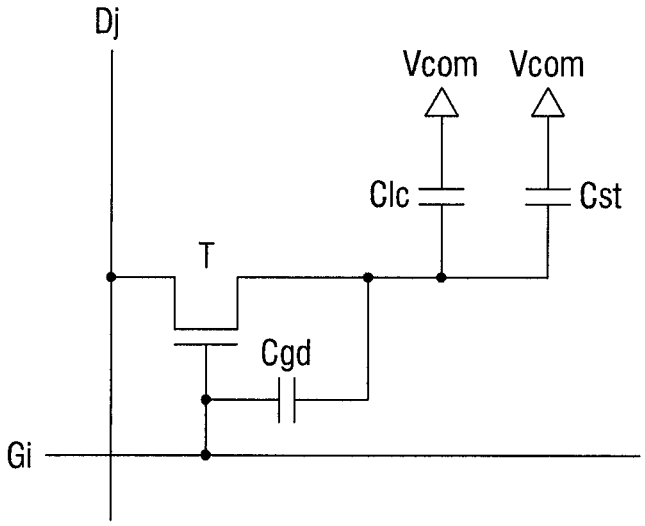
FIG. 2 is a circuit diagram of a pixel according to an embodiment of the present invention.

FIG. 2 is a circuit diagram of a pixel according to an embodiment of the present invention. Referring to FIG. 2, the pixel includes a thin film transistor T, a liquid crystal capacitor (CIO, and a storage capacitor (Cst). The thin film transistor T has a gate connected to an ith gate line Gi, a source connected to a jth data line Dj, and a drain connected to an end (for example, a terminal) of the liquid crystal capacitor Clc and an end of the storage capacitor Cst, where i is a natural number between 1 and n, and j is a natural number between 1 and m. The thin film transistor T is turned on or off according to a gate signal applied to the ith gate line Gi. If the thin film transistor T is turned on, a data signal applied to the jth data line Dj is transmitted to the liquid crystal capacitor Clc and the storage capacitor Cst.

Parasitic capacitance Cgd may be formed between the gate and drain of the thin film transistor T. If there is parasitic capacitance Cgd between the gate and drain of the thin film transistor T, kickback voltage Vkb may be generated at the liquid crystal display device 1000. The kickback voltage Vkb can be represented by the following equation:

$$Vkb = \frac{Cgd}{Cgd + Clc + Cst}(Vgh - Vgl),$$

where Vgh is a voltage of the gate signal in a high state (for example, the gate signal is high), and Vgl is a voltage of the gate signal in a low state (for example, when the gate signal is low).

The liquid crystal capacitor Clc is a capacitance component of a liquid crystal layer included in the liquid crystal panel 100. The light transmittance of the liquid crystal layer varies according to the voltage applied to the liquid crystal capacitor Clc. The liquid crystal capacitor Clc has one end connected to the drain of the thin film transistor T and the other end receiving a common voltage Vcom. The storage capacitor Cst also has one end connected to the drain of the thin film transistor T and the other end receiving the common voltage Vcom. The storage capacitor Cst may further help maintain the voltage applied to the liquid crystal capacitor Clc when the thin film transistor T is turned off.

Referring back to FIG. 1, the liquid crystal panel 100 includes a detector 110. The detector 110 detects kickback voltage Vkb generated at the liquid crystal panel 100 and outputs a kickback voltage detection signal Vkbs corresponding to the kickback voltage Vkb. The detector 110 receives a reference voltage Vref from the common voltage generator 210. In one embodiment, the kickback voltage detection signal Vkbs reflects the effect of the kickback voltage Vkb on the reference voltage Vref. As shown in FIG. 1, the detector 110 is located in the peripheral region of the liquid crystal panel 100. In one embodiment, the detector 110 includes at least one detection pixel 111, an embodiment of which will be now described with reference to FIG. 3.

Figure 3:
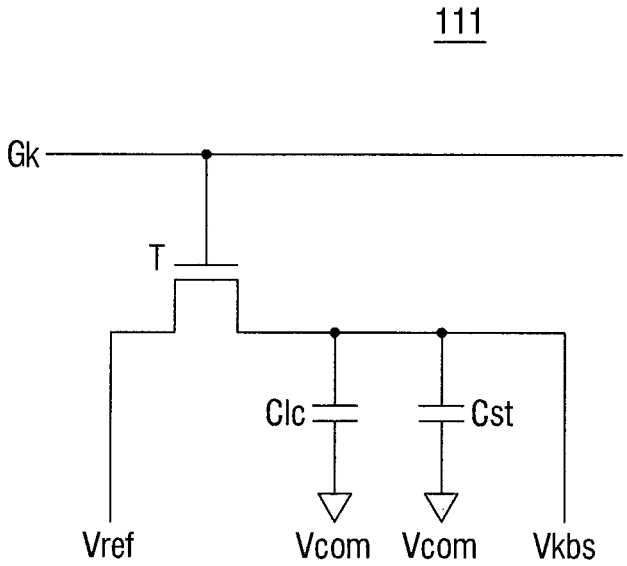
FIG. 3 is a circuit diagram of a detection pixel according to an embodiment of the present invention.

FIG. 3 is a circuit diagram of a detection pixel 111 according to an embodiment of the present invention. Referring to FIG. 3, the detection pixel 111 includes a thin film transistor T, a liquid crystal capacitor Clc, and a storage capacitor Cst. The thin film transistor T of the detection pixel 111 may be formed by the same process as the thin film transistor T of the pixel shown in FIG. 2. The thin film transistor T of the detection pixel 111 has a gate connected to a kth gate line Gk, a source for receiving a reference voltage Vref, and a drain for outputting the kickback voltage detection signal Vkbs. The kickback voltage detection signal Vkbs reflects the effect of the kickback voltage Vkb on the reference voltage Vref. One end of the liquid crystal capacitor Clc and of the storage capacitor Cst are connected to the drain of the thin film transistor T, and a common voltage Vcom is applied to the other end of each of the liquid crystal capacitor Clc and the storage capacitor Cst.

Referring back to FIG. 1, the common voltage generator 210 supplies the common voltage Vcom to the liquid crystal panel 100. The common voltage generator 210 supplies the reference voltage Vref to the detector 110 and receives the kickback voltage detection signal Vkbs from the detector 110. In one embodiment, the common voltage generator 210 senses the kickback voltage Vkb from the kickback voltage detection signal Vkbs and generates the common voltage Vcom having an adjusted voltage value to compensate for the effect of the kickback voltage Vkb. The operation of the common voltage generator 210 (for adjusting the common voltage Vcom) will now be described in more detail with reference to FIG. 4.

Figure 4:
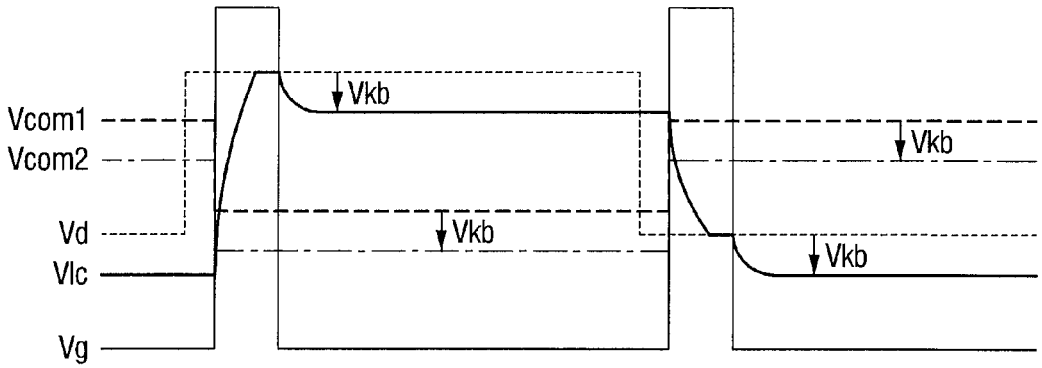
FIG. 4 is a graph illustrating a gate signal, a liquid crystal voltage, a data voltage, a first common voltage, and a second common voltage according to an embodiment of the present invention.

FIG. 4 is a graph illustrating a gate signal Vg, a liquid crystal voltage Vic, a data voltage, a first common voltage, and a second common voltage according to an embodiment of the present invention.

The gate signal Vg turns the thin film transistor T on or off. For example, when the gate signal Vg is high, the thin film transistor T is turned on, and when the gate signal Vg is low, the thin film transistor T is turned off. Vgh represents the voltage when the gate signal Vg is high, and Vgl represents the voltage when the gate signal Vg is low. The liquid crystal voltage Vic represents the voltage applied to the end of the liquid crystal capacitor Clc connected to the thin film transistor T.

When the gate signal Vg is high, the thin film transistor T is charged by the data voltage Vd of the data signal applied to a corresponding one of the data lines D1, D2, . . . , and Dm, as illustrated by the graph of the liquid crystal voltage Vic. When the gate signal Vg then goes low, the liquid crystal voltage Vic drops by the kickback voltage Vkb. To compensate for this drop in the liquid crystal voltage Vic by the kickback voltage Vkb, embodiments of the present invention provide for an (uncompensated) first common voltage Vcom1 and a (compensated) second common voltage Vcom2 that reflects the first common voltage Vcom1 after compensating for the kickback voltage Vkb.

In order to reduce or prevent performance deterioration of the liquid crystal panel 100, the liquid crystal panel 100 may be driven by an inversion driving method. When the liquid crystal panel 100 is driven by the inversion driving method, polarities of the common voltage Vcom (for example, the first common voltage Vcom1) and the data voltage Vd are inverted each frame, as illustrated in FIG. 4, which shows consecutive frames being driven with normal and inverted polarities of the data voltage Vd and the common voltage Vcom. As can be seen in FIG. 4, if the (uncompensated) first common voltage Vcom1 is supplied to the liquid crystal panel 100 as the common voltage Vcom, the data voltage Vd, as represented by the liquid crystal voltage Vic, is adjusted downward by the kickback voltage Vkb (i.e., closer to the first common voltage Vcom1) during frames of normal polarities, and is also adjusted downward by the kickback voltage Vkb (i.e., further from the first common voltage Vcom1) during frames of reverse polarity, due to inversion driving. In this case, picture quality deterioration, such as flicker, may occur. In addition, since the liquid crystal voltage Vic is the kickback voltage Vkb lower than the desired voltage value, brightness reproducibility of a picture image displayed on the display liquid crystal panel 100 may deteriorate.

Accordingly, in one embodiment, the common voltage generator 210 detects the kickback voltage Vkb and generates the (compensated) second common voltage Vcom2, which is the common voltage Vcom adjusted to compensate for the effect of the kickback voltage Vkb on the liquid crystal voltage Vic. In one embodiment, the second common voltage Vcom2 is lower than the first common voltage Vcom1 by the kickback voltage Vkb. If the second common voltage Vcom2 is lower than the first common voltage Vcom1 by the kickback voltage Vkb, even when the liquid crystal voltage Vic drops due to the kickback voltage Vkb, the common voltage Vcom (i.e., the second common voltage Vcom2) also drops by the kickback voltage Vkb, thereby maintaining the voltages of both ends of the liquid crystal capacitor Clc at desired levels. Therefore, the common voltage generator 210 adjusts a voltage value of the common voltage Vcom to compensate for the effect of the kickback voltage Vkb on the liquid crystal voltage Vic, thereby suppressing display quality deterioration due to the kickback voltage Vkb, such as flicker or a reduction in brightness reproducibility.

Referring back to FIG. 1, the liquid crystal display device 1000 further includes a timing controller 220, a gate driver 230, and a data driver 240. The timing controller 220 generates a gate control signal GCS for controlling the gate driver 230 and a data control signal DCS for controlling the data driver 240. The timing controller 220 controls the gate driver 230 and the data driver 240 to allow the liquid crystal panel 100 to display a desired image through the gate control signal GCS and the data control signal DCS. The gate driver 230 receives the gate control signal GCS to then generate a gate signal corresponding thereto and applies the gate signal to the gate lines G1, G2, . . . , and Gn. The data driver 240 receives the data control signal DCS to then generate a data signal corresponding thereto and applies the data signal to the data lines D1, D2, . . . , and Dm. The common voltage generator 210, the timing controller 220, the gate driver 230, and the data driver 240 may be generally referred to as a driver 200.

Figure 5:
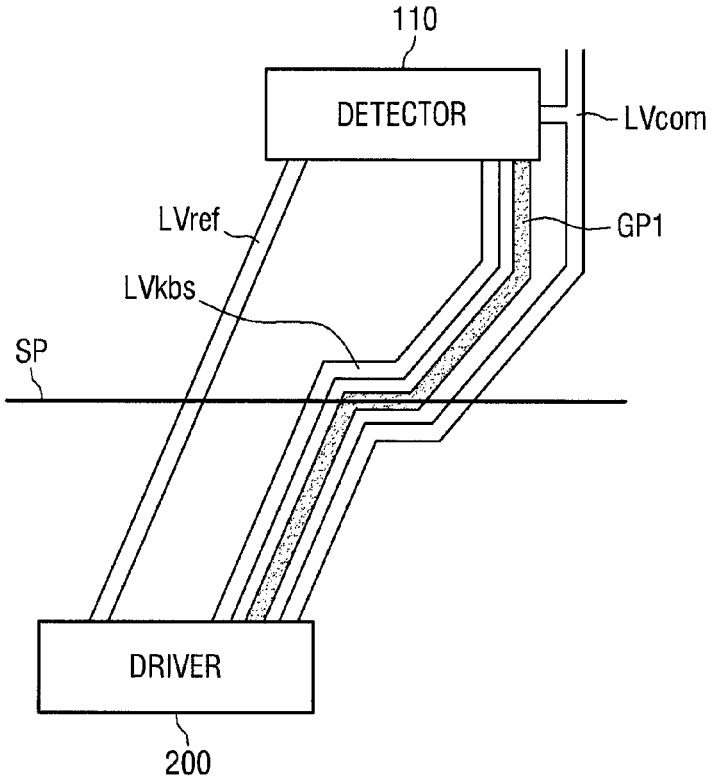
FIG. 5 is a plan view illustrating lines between a detector and a driver according to an embodiment of the present invention.

FIG. 5 is a plan view illustrating lines between a detector 110 and a driver 200 according to an embodiment of the present invention. The lines between the detector and the driver shown in FIG. 5 may be included in the liquid crystal panel 100.

The liquid crystal panel 100 includes a detection line LVkbs for supplying a kickback voltage detection signal Vkbs. A first ground pattern GP1 is arranged at one side of the detection line LVkbs. For example, the first ground pattern GP1 may be arranged along and adjacent to one side the detection line LVkbs, as illustrated in FIG. 5. FIG. 5 shows that the first ground pattern GP1 is a pattern having a uniform width extending between the detector 110 and the driver 200, but the shape of the first ground pattern GP1 is not limited thereto. In other embodiments, the first ground pattern GP1 may have some regions disconnected from each other, have non-uniform widths, or not extend to the detector 110 or the driver 200. The liquid crystal display device 1000, which includes the first ground pattern GP1 provided at one side of the detection line LVkbs, may help suppress the detection line LVkbs from being affected by external noises, thereby allowing the common voltage generator 210 to accurately detect a kickback voltage Vkb.

The first ground pattern GP1 may contact a sealing pattern SP. For example, an insulation layer may be formed on the first ground pattern GP1, and an opening may be formed on the insulation layer at a contact region of the first ground pattern GP1 and the sealing pattern SP. The sealing pattern SP will now be described in more detail with reference to FIG. 6.

Figure 6:
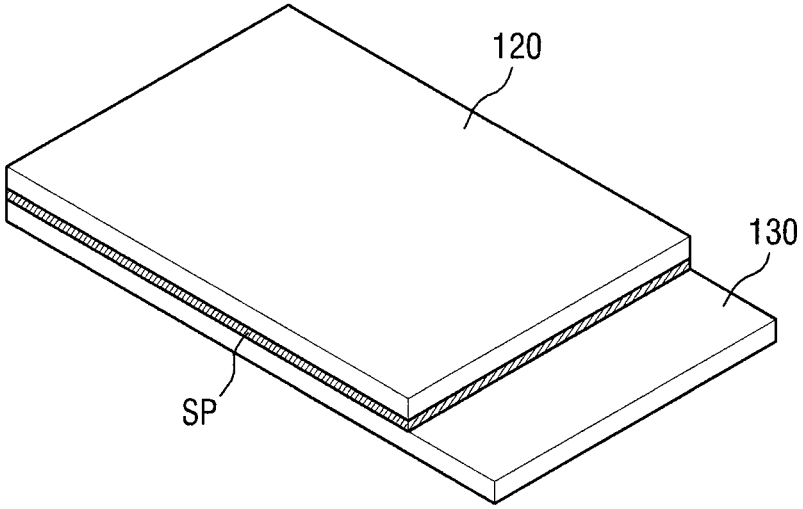
FIG. 6 is a perspective view of a liquid crystal panel according to an embodiment of the present invention.

FIG. 6 is a perspective view of a liquid crystal panel 100 according to an embodiment of the present invention. Referring to FIG. 6, the liquid crystal panel 100 includes a first substrate 120, a second substrate 130, a sealing pattern SP, and a liquid crystal layer between the first substrate 120 and the second substrate 130. In one embodiment, the sealing pattern SP adheres the first substrate 120 to the second substrate 130 and seals the liquid crystal layer between the first substrate 120 and the second substrate 130. The sealing pattern SP is arranged along the periphery (for example, a boundary) of an overlapping area of the first substrate 120 and the second substrate 130. The sealing pattern SP may be made of a non-conductive material. However, the non-conductive property of the sealing pattern SP may not be perfect and noises may be transmitted through the sealing pattern SP. Therefore, the sealing pattern SP is brought into contact with the first ground pattern GP1 to reduce noise transmission through the sealing pattern SP, thereby suppressing the kickback voltage detection line VLkbs from being affected by the noises.

Referring back to FIG. 5, a portion of the first ground pattern GP1 is parallel with the sealing pattern SP. In some embodiments, the first ground pattern GP1 contacts the sealing pattern SP at a region where it is parallel to the sealing pattern SP. If the first ground pattern GP1 contacts the sealing pattern SP at a region where it is parallel to the sealing pattern SP, a contact area between the first ground pattern GP1 and the sealing pattern SP may increase, thereby increasing noise-blocking efficiency. The liquid crystal panel 100 further includes a common voltage line LVcom and a reference voltage line LVref. A common voltage Vcom may be applied to the common voltage line LVcom, and a reference voltage Vref may be applied to the reference voltage line LVref.

As shown in FIG. 5, the common voltage line LVcom is arranged at one side of the detection line LVkbs, and the reference voltage line LVref is arranged at the other side of the detection line LVkbs. However, the arrangement of the common voltage line LVcom and the detection line LVkbs may vary in other embodiments. In addition, the first ground pattern GP1 is arranged between the detection line LVkbs and the common voltage line LVcom. When the first ground pattern GP1 is arranged between the detection line LVkbs and the common voltage line LVcom, then the first ground pattern GP1 may suppress noises in the common voltage line LVcom from affecting the detection line LVkbs. In some embodiments, the common voltage generator 210 may be a separate device distinguished from the timing controller 220, the gate driver 230, and the data driver 240. In this case, the driver 200 shown in FIG. 6 may be replaced by the common voltage generator 210.

Figure 7:
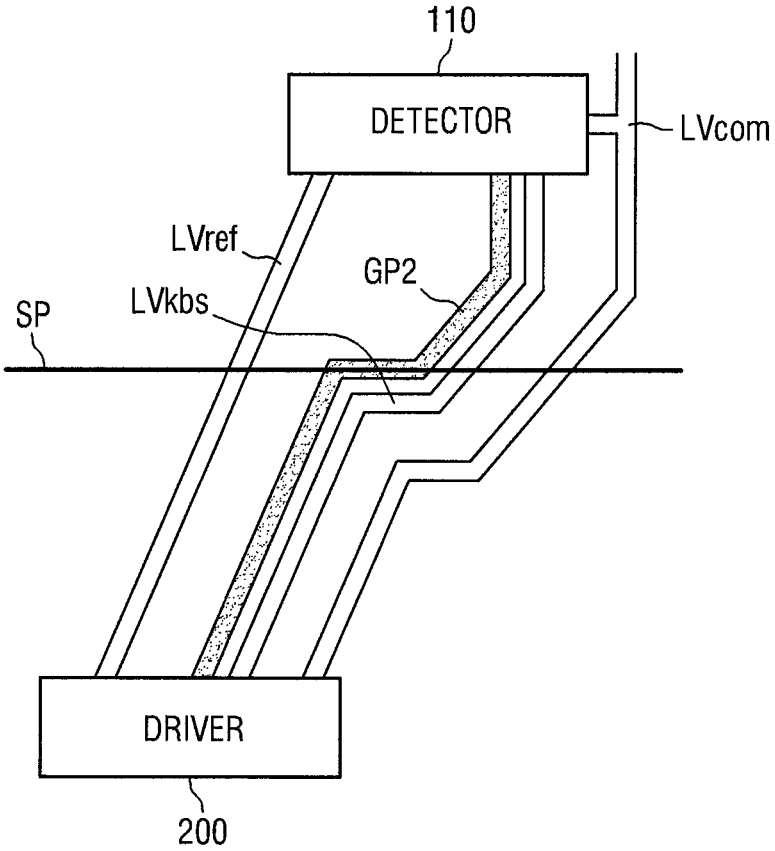
FIG. 7 is a plan view illustrating lines between a detector and a driver according to another embodiment of the present invention.

FIG. 7 is a plan view illustrating lines between a detector 110 and a driver 200 according to another embodiment of the present invention. Referring to FIG. 7, a liquid crystal panel 100 may include a detection line LVkbs, a common voltage line LVcom, a reference voltage line LVref, and a second ground pattern GP2. The detection line LVkbs, the common voltage line LVcom, and the reference voltage line LVref are substantially the same as those shown in FIG. 5 and explanations thereof will not be repeated.

As shown in FIG. 7, the second ground pattern GP2 is formed along and adjacent to one side of the detection line LVkbs and may be arranged between the reference voltage line LVref and the detection line LVkbs. When the second ground pattern GP2 is arranged between the reference voltage line LVref and the detection line LVkbs, it is possible to suppress noises from being transmitted from the reference voltage line LVref to the detection line LVkbs. It is also possible to suppress the reference voltage line LVref from being affected by the signal applied to the detection line LVkbs. Therefore, a common voltage generator 210 included in a driver 200 can accurately detect a kickback voltage Vkb. FIG. 7 shows that the second ground pattern GP2 has a uniform width extending between the detector 110 and the driver 200, but the shape of the second ground pattern GP2 is not limited thereto. In other embodiments, the second ground pattern GP2 may have some regions disconnected from each other, have non-uniform widths, or not extend to the detector 110 or the driver 200.

The second ground pattern GP2 may contact the sealing pattern SP. For example, an insulation layer may be formed on the second ground pattern GP2, and an opening may be formed on the insulation layer at a contact region of the second ground pattern GP2 and the sealing pattern SP. When the second ground pattern GP2 contacts the sealing pattern SP, noise transmission through the sealing pattern SP is reduced, thereby suppressing the effect of the noise on the kickback voltage detection line VLkbs. In FIG. 7, a portion of the second ground pattern GP2 is parallel with the sealing pattern SP. In some embodiments, the second ground pattern GP2 contacts the sealing pattern SP at a region where it is parallel to the sealing pattern SP. When the second ground pattern GP2 contacts the sealing pattern SP at a region where it is parallel to the sealing pattern SP, a contact area between the second ground pattern GP2 and the sealing pattern SP may increase, thereby increasing noise-blocking efficiency.

Figure 8:
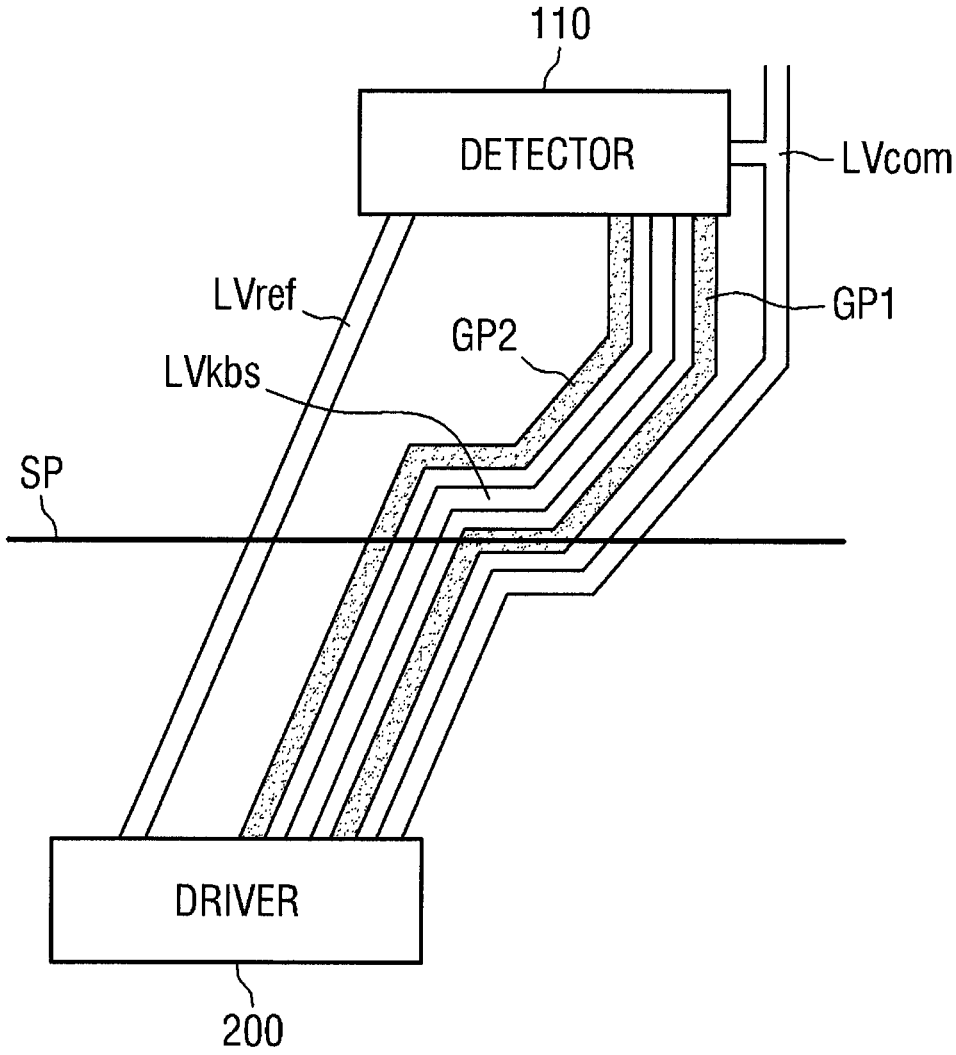
FIG. 8 is a plan view illustrating lines between a detector and a driver according to still another embodiment of the present invention.

FIG. 8 is a plan view illustrating lines between a detector 110 and a driver 200 according to still another embodiment of the present invention.

Referring to FIG. 8, a liquid crystal panel 100 includes a detection line LVkbs, a common voltage line LVcom, a reference voltage line LVref, a first ground pattern GP1, and a second ground pattern GP2. The detection line LVkbs, the common voltage line LVcom, the reference voltage line LVref, and the first ground pattern GP1 are substantially the same as those shown in FIG. 5 while the second ground pattern GP2 is substantially the same as that shown in FIG. 7. When the first ground pattern GP1 is arranged at one side of the detection line LVkbs and the second ground pattern GP2 is arranged at the other side of the detection line LVkbs, it is possible to more efficiently suppress noises from affecting the detection line LVkbs than when only one of the first ground pattern GP1 or the second ground pattern GP2 is present.

The first ground pattern GP1 or the second ground pattern GP2 may contact the sealing pattern SP. Alternatively, both of the first ground pattern GP1 and the second ground pattern GP2 may contact the sealing pattern SP. In FIG. 8, a portion of the first ground pattern GP1 is parallel with the sealing pattern SP. In some embodiments, the first ground pattern GP1 contacts the sealing pattern SP at a region where it is parallel to the sealing pattern SP. When the first ground pattern GP1 contacts the sealing pattern SP at a region where it is parallel to the sealing pattern SP, a contact area between the first ground pattern GP1 and the sealing pattern SP may increase, thereby increasing noise-blocking efficiency.

Figure 9:
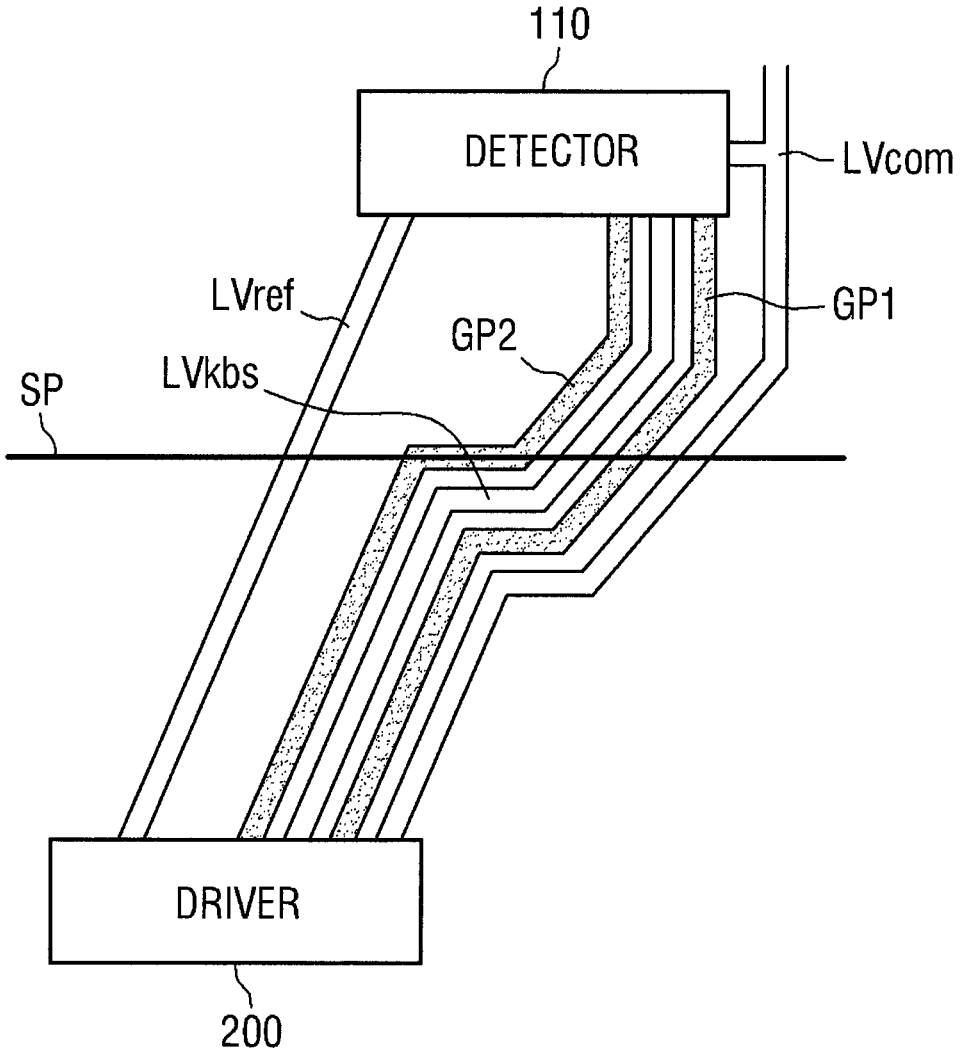
FIG. 9 is a plan view illustrating lines between a detector and a driver according to still another embodiment of the present invention.

FIG. 9 is a plan view illustrating lines between a detector 110 and a driver 200 according to still another embodiment of the present invention.

Referring to FIG. 9, a liquid crystal panel 100 includes a detection line LVkbs, a common voltage line LVcom, a reference voltage line LVref, a first ground pattern GP1, and a second ground pattern GP2. In FIG. 9, a portion of the second ground pattern GP2 is parallel with the sealing pattern SP. In some embodiments, the second ground pattern GP2 contacts the sealing pattern SP at a region where it is parallel to the sealing pattern SP. When the second ground pattern GP2 contacts the sealing pattern SP at a region where it is parallel to the sealing pattern SP, a contact area between the second ground pattern GP2 and the sealing pattern SP may increase, thereby increasing noise-blocking efficiency. Explanations of the other functional components are substantially the same as those of FIG. 8.

Figure 10:
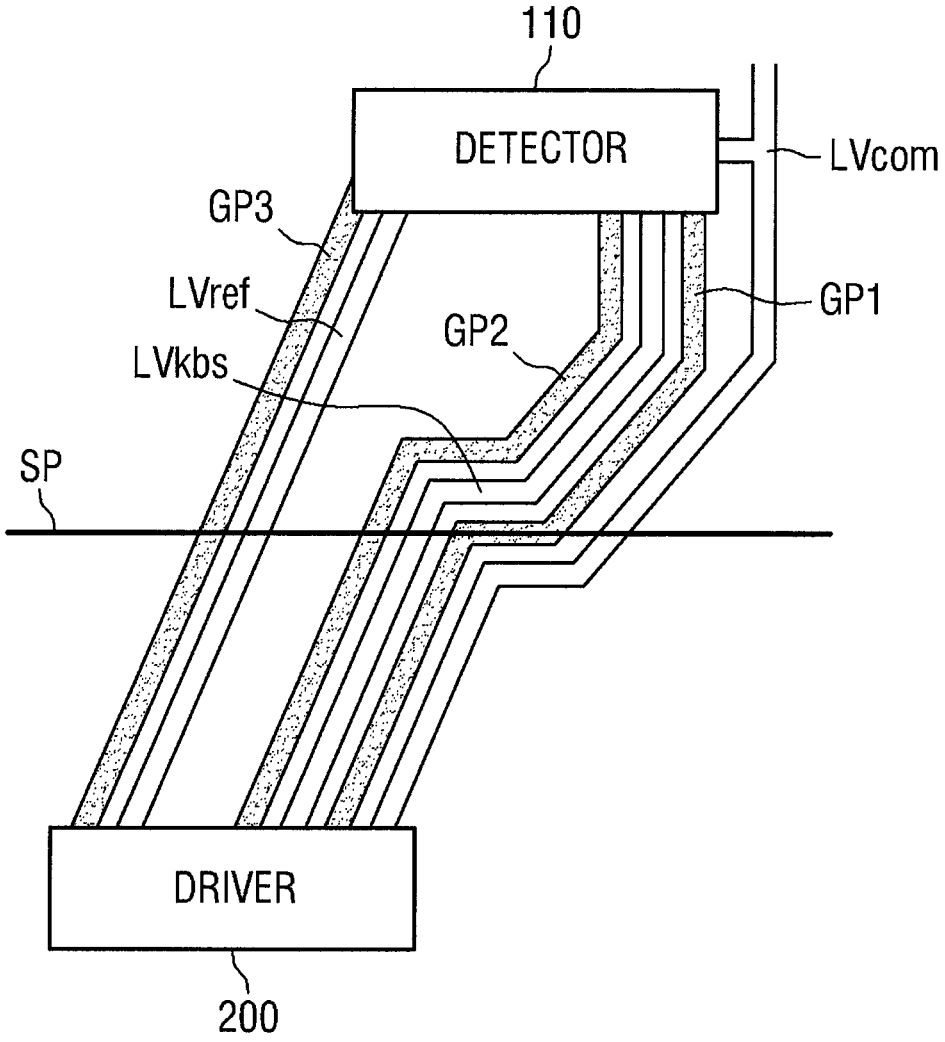
FIG. 10 is a plan view illustrating lines between a detector and a driver according to still another embodiment of the present invention.

FIG. 10 is a plan view illustrating lines between a detector 110 and a driver 200 according to still another embodiment of the present invention.

Referring to FIG. 10, a liquid crystal panel 100 includes a detection line LVkbs, a common voltage line LVcom, a reference voltage line LVref, a first ground pattern GP1, a second ground pattern GP2, and a third ground pattern GP3. In FIG. 10, the third ground pattern GP3 is formed along and adjacent to one side of the reference voltage line LVref, namely the side opposite to that in which the second ground pattern GP2 is arranged. FIG. 10 shows that the third ground pattern GP3 is a pattern having a uniform width extending between the detector 110 and the driver 200, but the shape of the third ground pattern GP3 is not limited thereto. In other embodiments, the third ground pattern GP3 may have some regions disconnected from each other, have non-uniform widths, or not extend to the detector 110 or the driver 200. A liquid crystal display device 1000, which includes the third ground pattern GP3 provided at the other side of the reference voltage line LVref, may suppress the detection line LVkbs from being affected by external noises, thereby allowing a common voltage generator 210 to accurately detect a kickback voltage Vkb.

The third ground pattern GP3 may contact the sealing pattern SP. For example, an insulation layer may be formed on the third ground pattern GP3, and an opening may be formed on the insulation layer at a contact region of the third ground pattern GP3 and the sealing pattern SP. If the sealing pattern SP is brought into contact with the third ground pattern GP3, noise transmission through the sealing pattern SP may be reduced, thereby suppressing the noise from affecting the reference voltage line VLref.

FIG. 10 illustrates that a region of the first ground pattern GP1, which is formed to be parallel with the sealing pattern SP, is arranged to overlap the sealing pattern SP. In some embodiments, as shown in FIG. 9, a region of the second ground pattern GP2, which is formed to be parallel with the sealing pattern SP, may be arranged to overlap the sealing pattern SP. Explanations of the other functional components are substantially the same as those of FIGS. 8 and 9, and explanations will not be repeated.

While the present invention has been particularly shown and described with reference to exemplary embodiments thereof, it will be understood by those of ordinary skill in the art that various changes in form and details may be made therein without departing from the spirit and scope of the present invention as defined by the following claims, and their equivalents. The above embodiments should be considered in all respects as illustrative and not restrictive, reference being made to the appended claims (and their equivalents), rather than the foregoing description, to indicate the scope of the present invention.

What is claimed is:

1. A liquid crystal display device comprising:

a liquid crystal panel comprising:

a detector configured to generate a kickback voltage detection signal;

a first substrate;

a second substrate facing the first substrate;

a liquid crystal layer between the first substrate and the second substrate; and a sealing pattern adhering the first substrate to the second substrate and sealing the liquid crystal layer in a first direction along one side of the liquid crystal display, the first direction being a lengthwise direction of the one side, the sealing pattern defining a contact portion on the one side extending lengthwise in the first direction;

a detection line for supplying the kickback voltage detection signal, the detection line extending lengthwise in the first direction at a region corresponding to the contact portion; and a ground pattern along and adjacent to one side of the detection line and extending lengthwise and contacting the sealing pattern in the first direction along the contact portion between the first substrate and the sealing pattern and a common voltage generator connected to the detection line and configured to generate a common voltage corresponding to the kickback voltage detection signal and to supply the generated common voltage to the liquid crystal panel.

2. The liquid crystal display device of claim 1, wherein the sealing pattern is arranged along a boundary where the first substrate and the second substrate overlap each other.

3. The liquid crystal display device of claim 1, wherein the detector is configured to receive a reference voltage and to output the reference voltage as changed by a kickback voltage as the kickback voltage detection signal.

4. The liquid crystal display device of claim 3, wherein the detector comprises a detection pixel.

5. The liquid crystal display device of claim 4, wherein the detection pixel comprises:

a thin film transistor comprising a gate connected to a gate line, a source for receiving the reference voltage, and a drain for outputting the kickback voltage detection signal; and a liquid crystal capacitor comprising an end connected to the drain and another end for receiving a common voltage.

6. The liquid crystal display device of claim 5, wherein the detection pixel further comprises a storage capacitor comprising an end connected to the drain and another end for receiving the common voltage.

7. The liquid crystal display device of claim 4, wherein the liquid crystal panel comprises a display region and a peripheral region comprising the detection pixel.

* * * * *